US005456773A

United States Patent [19]

Bittner et al.

[11] Patent Number: 5,456,773

[45] Date of Patent: Oct. 10, 1995

[54] HEAT TREATMENT PROCESS FOR METAL ARTICLES

[75] Inventors: Hans-Georg Bittner, Harsum; Hartmut Weber, Hildesheim, both of Germany

[73] Assignee: Heimsoth Verwaltungen GmbH & Co. KG, Hildesheim, Germany

[21] Appl. No.: 232,036

[22] PCT Filed: Mar. 26, 1993

[86] PCT No.: PCT/EP93/00741

§ 371 Date: Apr. 26, 1994

§ 102(e) Date: Apr. 26, 1994

[87] PCT Pub. No.: WO93/20248

PCT Pub. Date: Oct. 14, 1993

[30] Foreign Application Priority Data

Mar. 27, 1992 [DE] Germany ..... 42 09 978.1

[51] Int. Cl.[6] ..... C21D 9/00

[52] U.S. Cl. ..... 148/633; 266/252

[58] Field of Search ..... 148/633, 626, 148/656; 266/252, 257, 261; 432/133, 18

[56] References Cited

U.S. PATENT DOCUMENTS 5,314,170 5/1994 Tada et al. ..... 266/252

FOREIGN PATENT DOCUMENTS 1245023 9/1990 France .
3150576 12/1982 Germany .

OTHER PUBLICATIONS

J. Wunning, "Die Warmebehandlung in der Fertigungslinie mit einem neuartigen Rollenherdofen", *HTM Harterei–Technische Mittelungen,* 45, No. 6, Dec. 1990, pp. 325–329.

Daido Tokushuko KK, Abstract of Japanese Application No. JP820224597, Publication No. JP59113117, *Patent Abstracts of Japan,* vol. 008, No. 232, Oct. 24, 1984.

*Primary Examiner*—Scott Kastler
*Attorney, Agent, or Firm*—Lane, Aitken & McCann

[57] ABSTRACT

A heat treatment process in a roll type furnace for metal articles, in which the articles are heated in stages up to 800°–850° C. in several pre-heating zones with atmospheres containing free oxygen; the articles are heated in a high temperature zone in a reducing atmosphere containing no free oxygen and run through this zone relatively quickly; the burners of the high temperature zone are timed with high and low power periods, depending on the quantity of articles supplied and the amount of heat to be transmitted; rolls of the furnace are set in the high temperature zone at a short distance from each other; and baffle plates between the zones are set at the smallest possible distance from the rolling track or the articles on the rolling track. The burners are located above and below the rolling track.

6 Claims, 1 Drawing Sheet

HEAT TREATMENT PROCESS FOR METAL ARTICLES

BACKGROUND OF THE INVENTION

The invention relates to heat treatment for metal articles in a roll type furnace, in particular for relatively thin steel parts which easily warp when exposed to heat, such as ball bearing raceways, sheet metal rounds, blades and the like.

A device for heat treatment for metal articles is known (DE-PS 31 50 576), in which annealing frames equipped with the metal parts in the single divisions are disposed upon a rolling track. The annealing frames equipped with the metal articles are run through a furnace. It is however difficult to prevent that metal parts with a lengthwise dimension of some centimeters and a small thickness of some millimeters are not warped permanently after the heat treatment.

Furthermore, in connection with the heat treatment of metal parts it is up to now usual to use furnaces comprising an atmosphere containing protective gas and with partially electrical heating in order to prevent that e.g. the carbon content of the metal parts changes during the heat treatment process or the metal parts oxidize. For most metal parts, neither recarburization nor decarburization nor oxidation is desired.

SUMMARY OF THE INVENTION

The invention deals with the problem to allow a heat treatment of metal parts in which the metal parts do not warp and in which only insignificant marginal re- or decarburizations as well as insignificant marginal oxidations or marginal scaling occur.

This is achieved by a process of the kind mentioned in the introduction, characterized by the fact that the metal articles are heated in stages up to 800°–850° C. in several preheating zones (I, II) with atmospheres containing free oxygen, then the metal articles are heated in a high temperature zone (II) in a reducing atmosphere containing no free oxygen and run through this zone relatively quickly, the burners of the high temperature zone (III) are timed with shorter or longer periods, depending on the quantity of metal articles supplied and the amount of heat to be transmitted, and that the rolls are set in the high temperature zone (III) at a short distance from each other and the baffle plates (S, US) between the zones (I, II, III) are set at smallest possible distance from the rolling track or the metal articles on the rolling track, with the burners being located above and below the rolling track.

During the process according to the invention, at the beginning the temperature gradient immediately above the rolling track is so small that the metal articles that are present there cannot warp. Such a temperature distribution can however be achieved only with a roll type furnace heated directly with high speed burners. In a roll type furnace with sole upper heating or with application of auxiliary annealing means or annealing frames, this cannot be achieved.

In connection with the annealing operation of steel parts, according to the invention, ceramic rolls or rolls free from carbon with an adequate heat solidity are preferably applied. Furthermore, phenomenons known as "pittings" can be prevented this way, since no contact of hot metal with hot metal occurs during the annealing process, but the steel parts rest on the ceramic rolls. In known roll type furnaces for the heat treating metal industry, mainly metal rolls are employed, requiring a relatively large effort for the air or water cooling of the rolls.

To keep the oxygen content in the furnace as low as possible, the burners are operated without excess air in the high temperature area, like in the heat-treatment for the tempering of steel, the so-called austenitization area. In a process according to the present invention, the burners are adjusted in a way that no protective gas is required. This is caused by the fact that such metal parts easily scale on the surface, with a thickness of the layer of 0.01–0.03 mm approximately. This marginal scaling does not influence the product quality, on the contrary the scaling prevents that the metal articles re- or decarbonate, so that a uniform structure after the heat-treatment is achieved and only marginal scaling of 0.01–0.03 approximately occurs. This slight marginal decarbonization or scaling is often admitted since usually a surface treatment in following operation steps has to be performed anyway.

In the process according to the invention, the metal parts are run through the roll type furnace at different speeds. In the unheated pre-heating zones and the heated pre-heating zone, a speed depending on the thickness of the metal articles to be treated with heat is run, and when reaching a temperature of 850° C. approximately, the parts to be treated with heat are forwarded at a higher speed. This allows to limit the duration of the metal articles in the higher temperature area to a time interval not admitting perceptible re- or decarburization processes. In the third zone, in the case of steel the austenitization temperature, the metal parts are forwarded at an even higher speed. Having run through the high temperature zone, the hot articles are removed very quickly from the furnace.

In the roll type furnace for execution of the process according to the present invention, no doors at the inlet and at the outlet are required, instead it is possible to employ so-called baffle plates, with one or more thick baffle plates being positioned one after the other at the outlet.

If for execution of the process according to the invention, a furnace with a light fireproof casing, e.g. of fibrous materials, is used, the furnace can be heated and cooled quickly.

Since according to the invention, the temperature field immediately above the rolls can be adjusted at a spatial stability, it is possible to treat metal parts of different dimensions simultaneously, in particular if the thickness of these parts does not differ essentially. The temperature can be furthermore unified by employment of impulse burners or high speed burners that can be operated with a constant gas-air-mixture and also be operated at fixed times.

The metal annealing furnace for execution of the process according to the invention is divided into several zones complying with the following conditions:

In the first zone, the unheated pre-heating zone, the temperature of the articles is to be brought as uniformly as possible to 800°–850° C. approximately. This uniformity is important, so this zone can also be divided into several areas in which the respective temperature has to be raised to a certain value. The problem with thin metal rounds with large surfaces is that the ambient temperature is assumed faster at the outside than at the inside. If the ambient temperature is too high, it would be achieved quickly at the outside, while this is not the case at the inside, and a substantial difference from the inside to the outside would lead to warping of the part. Furthermore, the slow rising of the temperature causes a uniformization of the structure of the metal part, i.e. a kind of stress-relief heat treatment takes place. This stress was present due to any kind of pretreatment of the working part.

In the following step, the final temperature has to be achieved. For steel, it can be of up to 1200°. . . 1250° C. With this, it is important that the temperature has to be kept as precisely as possible, like e.g. with +/−1 K or at the most +/−5 K. Changes of this temperature that has to be kept as constant as possible cause temper changes and an undesired structure.

In the heated pre-heating zone, operation takes place in an atmosphere containing free oxygen, while in the high temperature zone, no free oxygen is present, but on the contrary a reducing atmosphere, like CO.

This results in the following advantages:

In the atmosphere containing oxygen, a scaling takes place. But if steel scales in an atmosphere containing oxygen, this results in a scaling layer that easily detaches from the surface and can simply be removed or splintered off. If during the initial time, a reducing atmosphere would be present, a so-called layer of adhesive scaling would form that could not be easily removed. For removal, long mechanical treatment processes have to be executed and/or acids or leaches have to be employed, which is highly undesirable. Since the duration of the working part at high temperature is very limited, i.e. much shorter than the duration at lower temperatures in the pre-heating zone of the furnace, the scaling layer can increase only little, in particular also because no more free oxygen is present, but only the reducing atmosphere.

The result is a thin scaling layer on the working part that easily chips off, so that no following operation process is required. Furthermore, depending on the temperature in the high temperature zone, also an adjustable and defined very fine grain-size distribution with a very fine structure and uniform distribution results.

For the invention, the division of the two zones and their delimitation by baffle plates is of particular importance.

From below it is preferably a baffle plate built with brick, from above a dividing wall formed of several ceramic tubes is provided that can be adjusted to the desired distance. Also the single rolls are at such a small distance from each other, at least in the high temperature zone, that also a division of the upper from the lower furnace is realized. This spatial division, resulting in a kind of heat chamber into which the articles to be heated are inserted, is also important in the case of nonuniform material supply. With furnaces, it is important that per time unit possibly the same quantity of articles is supplied, which in the practice cannot always be realized. In the first heated zone, a nonuniformity resulting from the passage from one working part to another is of minor importance, and in the first heated zone of the furnace, the same heat quantity is constantly supplied with quick performance changes. During the high temperature cycle, this method is not possible due to timing. If much material to be heated reaches the high temperature zone, the times are accordingly longer. If no material is present, heat is supplied less frequently or not at all. This nonuniformity with which the heat is supplied to the high temperature zone could result in oscillation phenomenons in furnaces without baffle plates. In the furnace employed according to the invention, in which the high temperature zone is divided from the other area of the furnace by baffle plates, no such oscillations occur. It has been proved that the temperature in the high temperature area can be kept constant with only a small tolerance. Furthermore, this arrangement of the rolls and roll baffle plates below the rolling track allows to adjust a higher temperature (e.g. 20 K more) to +/−1 K than above.

BRIEF DESCRIPTION OF THE DRAWING

The invention is exemplified below in the drawing:

The only figure shows a diagrammatic longitudinal view of a roll type furnace for execution of the process according to the invention.

DETAILED DESCRIPTION OF THE PREFERRED EMBODIMENT

Figure 1:
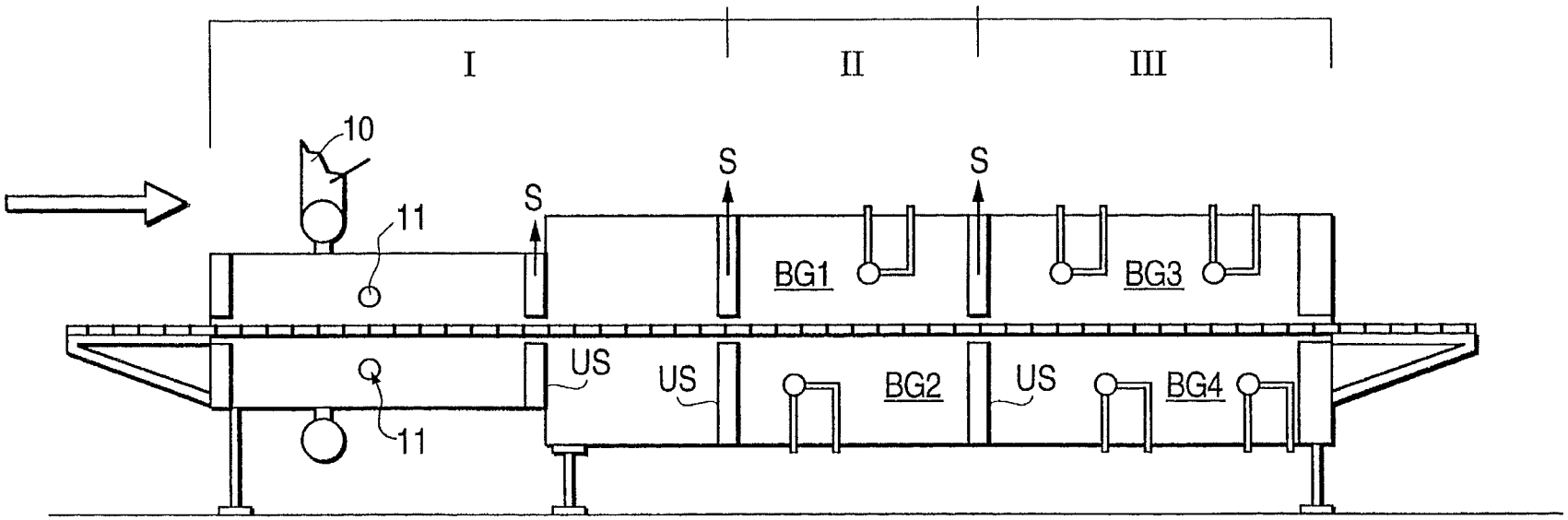

In the figure, a roll type furnace is shown schematically, with the rolling track clearly to be recognized due to the cross-sectional representation of the rolls. The input is positioned at the left, the output at the right, with the forwarding direction for the parts to be treated being marked with an arrow.

The furnace consists of three zones I, II, and III, divided spatially from each other.

In zone I, the unheated pre-heating zone, no burners are positioned. Here, the furnace gas is collected and discharged through a chimney 10. Furthermore, for adjustment of the temperature curve, air is injected through the inlets 11.

In the figure, the burners above and below the rolling track are represented schematically. In zone III, the high temperature zone, more burners than in zone II, the heated pre-heating zone, are shown.

Behind the high temperature zone, a quick release is arranged.

In zone I, the articles to be treated with heat are heated uniformly from the inside towards the outside.

Zone II includes the further heating of the articles until they reach the high temperature limit.

In zone III, the metal parts finally reach the high temperature area in which with e.g. steel is austenitized.

The burners in the zones II and III can be approached in groups above or below the rolling track to achieve the desired temperature profile.

S designates vertically adjustable baffle plates to divide the single zones thermically from each other.

US designates lower permanent baffle plates.

It is possible to admit the furnace fully automatically and to discharge it fully automatically with a cooling or hardening press. The product quality combined with the run of the goods is essential, with the goods not only being heated, but also cooled specifically.

We claim:

1. A heat treatment process for metal articles in a furnace or kiln having rolls and a rolling track, wherein the metal articles are heated in stages up to 800°–850° C. in several preheating zones with atmospheres containing free oxygen; the metal articles are heated in a high temperature zone having burners, in a reducing atmosphere containing no free oxygen, and are run through the high temperature zone relatively quickly; the burners of the high temperature zone are timed with high and low power periods, depending on the quantity of metal articles supplied and the amount of heat to be transmitted; the rolls are set in the high temperature zone at a short distance from each other; baffle plates are provided between the several preheating zones and between the pre-heating zones and the high temperature zone; and the baffle plates are set at the smallest possible distance from the rolling track or the metal articles on the rolling track.

2. The heat treatment process according to claim 1, wherein the metal articles are steel parts which tend to warp when exposed to heat.

3. The heat treatment process according to claim 1, wherein some of the baffle plates are set below the rolling track at the smallest possible distance from the rolling track, and the other baffle plates are set above the rolling track at the smallest possible distance from the metal articles on the rolling track.

4. The heat treatment process according to claim 1, wherein the burners are located above and below the rolling track.

5. The heat treatment process according to claim 1, wherein the metal articles are run through the high temperature zone at a higher speed than in the pre-heating zones.

6. A heat treatment process for metal articles in a furnace or kiln having rolls and a rolling track, wherein the metal articles are heated in stages up to 800°–850° C. in several pre-heating zones with atmospheres containing free oxygen; the metal articles are heated in a high temperature zone having burners, in a reducing atmosphere containing no free oxygen, and are run through the high temperature zone relatively quickly; the burners of the high temperature zone are timed with high and low power periods, depending on the quantity of metal articles supplied and the amount of heat to be transmitted; the rolls are set in the high temperature zone at a short distance from each other; the several pre-heating zones are thermically divided from one another and from the high temperature zone by baffle plates; and the baffle plates are set at the smallest possible distance from the rolling track or the metal articles on the rolling track.

* * * * *

UNITED STATES PATENT AND TRADEMARK OFFICE

CERTIFICATE OF CORRECTION

PATENT NO. : 5,456,773

DATED : October 10, 1995

INVENTOR(S) : Hans-Georg Bittner, et al.

It is certified that error appears in the above-indentified patent and that said Letters Patent is hereby corrected as shown below:

On the title page, item [73], the name of the Assignee should be "Heimsoth Verwaltungen GmbH & Co. KG Beteiligungsgesellschaft"

Signed and Sealed this

Twenty-seventh Day of February, 1996

*Attest:*

Bruce Lehman

BRUCE LEHMAN

*Attesting Officer*

*Commissioner of Patents and Trademarks*